US006205088B1

(12) United States Patent
Stempien

(10) Patent No.: US 6,205,088 B1
(45) Date of Patent: Mar. 20, 2001

(54) THERMAL GRAPHIC PEN AND METHOD OF USE

(75) Inventor: Joseph W. Stempien, Newington, CT (US)

(73) Assignee: Gerber Scientific Products, Inc., Manchester, CT (US)

( * ) Notice: Subject to any disclaimer, the term of this patent is extended or adjusted under 35 U.S.C. 154(b) by 0 days.

(21) Appl. No.: 09/078,472

(22) Filed: May 14, 1998

(51) Int. Cl.[7] ..... B41J 29/36; B41J 29/367; B41J 29/26

(52) U.S. Cl. ..... 367/179; 400/695; 400/697

(58) Field of Search ..... 347/179; 400/695, 400/697

(56) References Cited

U.S. PATENT DOCUMENTS 4,453,167 6/1984 Motoyoshi .
4,710,047 12/1987 Barouh et al. .

FOREIGN PATENT DOCUMENTS 92 08 293 10/1993 (DE) .
058 565 8/1982 (EP) .
61-241180 10/1986 (JP) .
63-197669 8/1988 (JP) .

*Primary Examiner*—Huan Tran
(74) *Attorney, Agent, or Firm*—McCormick, Paulding & Huber LLP

(57) ABSTRACT

A method and apparatus for filling a void in a printed image which has been printed by a thermal transfer printing process employs of a heat-sensitive pigmented material on a foil. A piece of the foil is provided with a dot of the pigmented material having the same color as that bordering the void to be filled and approximately the same size as the void. The foil is positioned on the printed image, with the dot facing and superposed over the void. Heat is applied to the back of the foil, opposite to the dot, while at least the heated portion of the foil is pressed against the image to transfer the pigmented material from the foil to the void in the image. Instead of a dot, the pigmented material can take the form of an image and be transferred from the foil to a receptor material. A heater for simultaneously applying heat and pressure to the foil comprises a handle, a heater element projecting from the handle, and a generally planar registration shield fixed to the handle and resiliently carried in spaced relation to the heater element, such that the heater element may be brought into contact with the shield by pressing the handle toward the shield.

31 Claims, 5 Drawing Sheets

THERMAL GRAPHIC PEN AND METHOD OF USE

FIELD OF THE INVENTION

The present invention pertains to thermal transfer printing and, more particularly, to a method and apparatus for the repair and creation of images printed by this process.

BACKGROUND

Thermal transfer printing processes utilize a heat-activated pigmented material which is transported on a thin polymer foil. The pigmented material is brought into contact with a receptor material, commonly a vinyl, paper or other receptor material, and heat and pressure are applied to the reverse side of the foil, causing the pigmented material to bond to the receptor material. When the foil is pulled from the receptor material, the pigmented material is released from the foil.

Heat is supplied by electric heating elements mounted in a linear array on a thermal print head. Each of these heating elements is individually controlled by a computer to heat up or to be allowed to cool down. In one application, the density of the heating elements is 300 per inch along the print head.

The receptor material and the foil are passed together under the print head, which presses the latter down on the former. At controlled intervals, the heating elements are caused to heat up and transfer pigmented material from the foil to the receptor material in controlled patterns defining a printed image. As the foil and receptor material emerge from beneath the print head, the foil is separated from the receptor material, leaving the printed image on the receptor material.

One example of a printing apparatus employing this process is shown in U.S. Pat. No. 5,537,135 and is sold by Gerber Scientific Products, Inc. under the trademark GERBER EDGE. The present invention is particularly suited for use with this printing apparatus.

If any foreign material is present between the foil and the receptor material, the transfer of pigmented material can be prevented or interrupted, resulting in a void or flaw in the printed image. These flaws, generally caused by flecks of dust or dirt, although quite small in size, are nevertheless noticeable and objectionable, particularly in large, solid color portions of an image.

It is a primary object of the present invention to provide a method and apparatus for the repair of voids or flaws in images printed by the thermal transfer printing process.

It is a further object to provide a repair method and apparatus which is convenient, inexpensive and does not necessitate the maintenance of an inventory of pigmented materials of various colors.

It is still a further object to provide a printing tool for the creation of small images from thermal transfers.

SUMMARY OF THE INVENTION

The present invention is directed to a method and apparatus for filling a void in a printed image which has been printed by a thermal transfer printing process wherein a heat-sensitive pigmented material, coated on a first surface of a foil carrier, is transferred to a first surface of a receptor material.

A piece of foil is provided, bearing a quantity of pigmented material of the same color as that bordering the void to be filled. The quantity of pigmented material is of approximately the same size as the void. The foil is positioned on the printed image, with the pigmented material facing and superposed over the void. Heat is applied to the foil, proximate to the pigmented material, while at least the heated portion of the foil is pressed against the receptor material, to transfer the pigmented material from the foil to the receptor.

Advantageously, the piece of foil used in the repair is a part of the foil used in the printing of the void-bearing image. A predetermined amount of the pigmented material is removed from an unused piece of the foil, the remaining amount of the material constituting the dot. A magnetic holder may be provided to facilitate handling of the piece of foil, which need not be removed from a cassette in which it is carried.

Yet further, a transparent guide member, having position indicating lines marked may be provided to facilitate the positioning of the foil.

The method and apparatus can also be used to create small images from thermal transfers. The apparatus employs a heater for simultaneously applying heat and pressure to the foil which comprises a handle, a heater element projecting from the handle, and a generally planar registration shield fixed to the handle and resiliently carried in spaced relation to the heater element, such that the heater element may be brought into contact with the shield by pressing the handle downwardly while the shield is supported on a fixed surface.

BRIEF DESCRIPTION OF THE PREFERRED EMBODIMENT

The repair process of the present invention is directed to the bonding of pigmented material to a receptor material where such bonding failed to occur during an original thermal transfer printing operation. Since the pigmented material from the original printing process is available as a coating on a foil, the repair process is based upon the use of such foil.

It should be apparent to the reader that transfer of pigmented material from a foil to a receptor to fill a void must involve conditions of heat and pressure similar to those of the original printing operation. It might be assumed, therefore, that such repairs could be effected by simply placing a piece of foil, bearing pigmented material of the desired color, over the void and heating with an appliance such as a soldering iron. This intuitive solution is, however, unsatisfactory for a number of reasons which I have ascertained.

Figure 1:
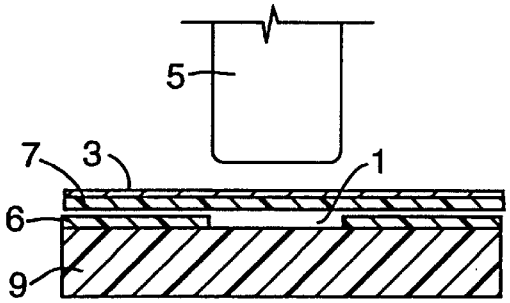
FIG. 1 is a cross-sectional view of a void in a printed image on a receptor sheet, prior to repair by non-preferred means.
Figure 2:
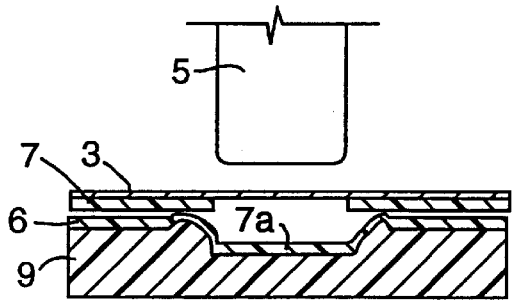
FIG. 2 is a cross-sectional view of the void of FIG. 1 after repair by the non-preferred means.

A major constraint on the repair process arises from the heat sensitivity of the sheet, such as vinyl, which comprises the receptor material. In FIG. 1, there is illustrated at a magnified scale a flawed image, i.e. having a hole or void 1 in the pigment layer 6 on the receptor material 9, with a piece of foil 3 superposed over the void 1. A heating device 5, such as a soldering iron, is poised above the foil 3 in preparation for heating the foil 3 to effect transfer of a portion 7*a* (FIG. 2) of the pigmented material 7 carried thereon to the receptor 9. Unfortunately, the temperature necessary to effect the transfer of many pigments is above the temperature at which the vinyl softens and begins to flow. Since it is, at best, very difficult to manually stop the heating at the surface of the vinyl receptor and also since some pressure is necessary to cause the transfer of the pigmented material and create the proper bonding with the receptor, the heating device inevitably presses into the vinyl material. As illustrated in FIG. 2, this causes a flow of the softened vinyl, resulting in visible and, hence, unacceptable surface distortions.

Another problem resulting from the use of the intuitive repair procedure above-mentioned is the discoloration or "clouding" of the pigmented material adjacent the repaired void. I have determined that such clouding is caused by pigmented material, at the edge of the heated area of the foil, which is just below the transfer temperature, or at the transfer temperature but not under sufficient pressure to transfer. This marginal material produces a product which distorts the reflectivity of the pigment already on the receptor.

Further, I have determined that, due to the translucent nature of the pigmented materials, any overlap between the newly transferred material and that transferred during the original printing operation will produce new colors, even if such a pigmented material is placed upon itself. While such color variations are less noticeable than the void itself, they are clearly undesirable.

To solve the foregoing problems, I have invented the hereinafter described image repair method and apparatus.

Firstly, I have invented a heating device having means to avoid distortion of the vinyl receptor material while at the same time allowing the heat to reach the pigmented material and allowing pressure to be applied thereto.

Figure 3A:
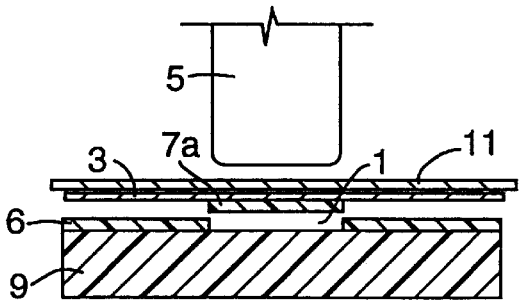
FIG. 3*a* is a cross-sectional view of a void in a printed image, prior to repair in accord with the present invention.
Figure 3B:
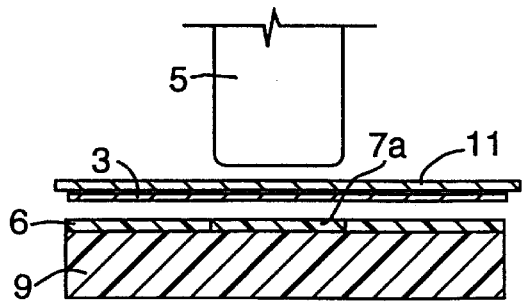
FIG. 3*b* is a cross-sectional view of the void of FIG. 3*a*, after repair in accord with the present invention.

As schematically illustrated in FIG. 3*a*, 3*b*, 4 and 5, my improved heating device 20 includes a planar metal registration shield 11, about 0.007 inches thick, which in a repair operation is disposed between the heater element 5 and the foil 3. The shield 11 allows a localized but less intense heating of the foil 3 and, at the same time, serves to spread the pressure being applied to the foil 3 over a greatly increased area. Any of the vinyl material 9 which is softened is constrained against movement by the shield 11 and prevents the formation of depressions and extrusions at the vinyl surface. Distortion of the vinyl receptor material 9 is thus substantially reduced, if not entirely eliminated as shown in FIG. 3*b*.

Figure 4:
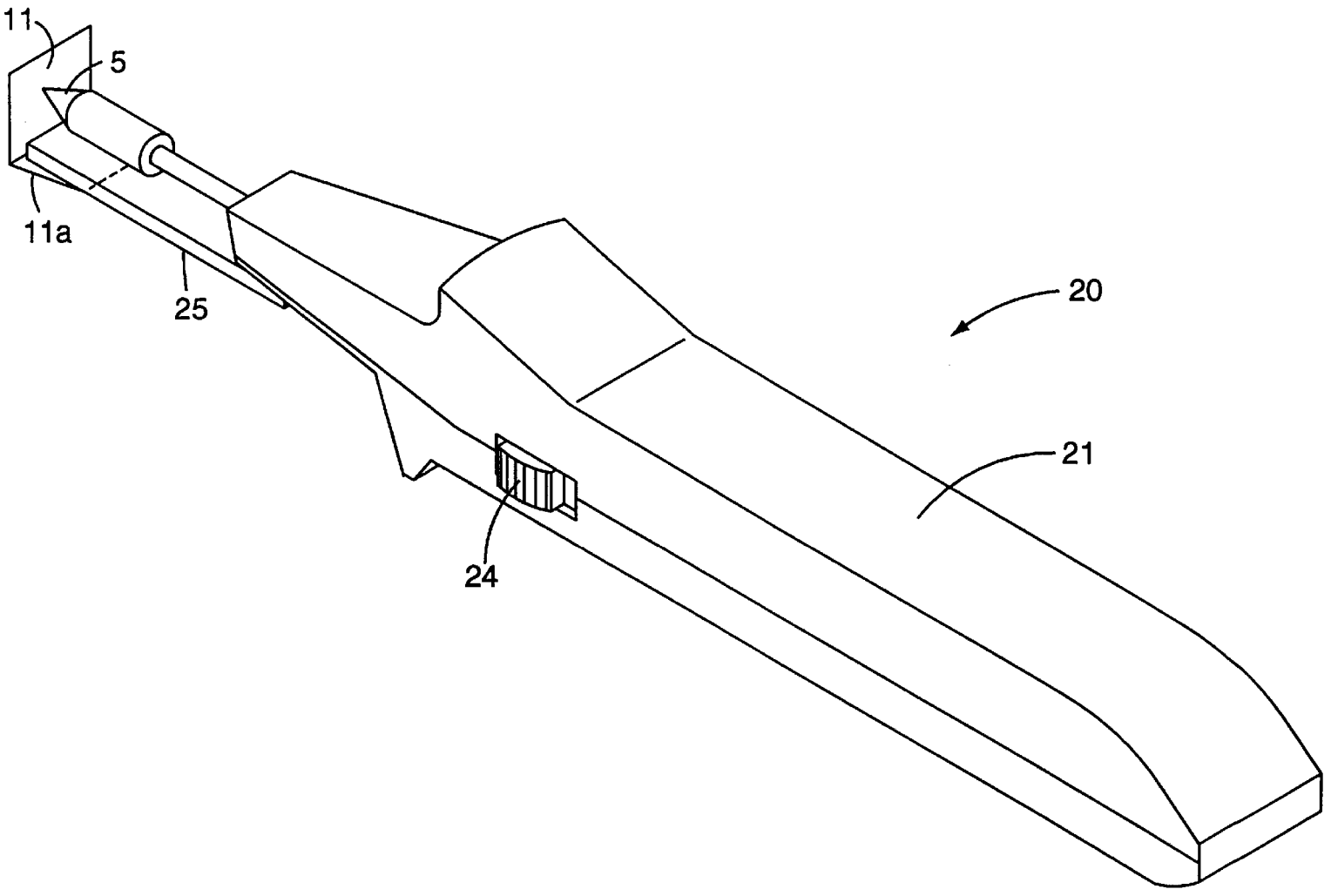
FIG. 4 is a perspective view of a heating device in accord with the present invention.
Figure 5:
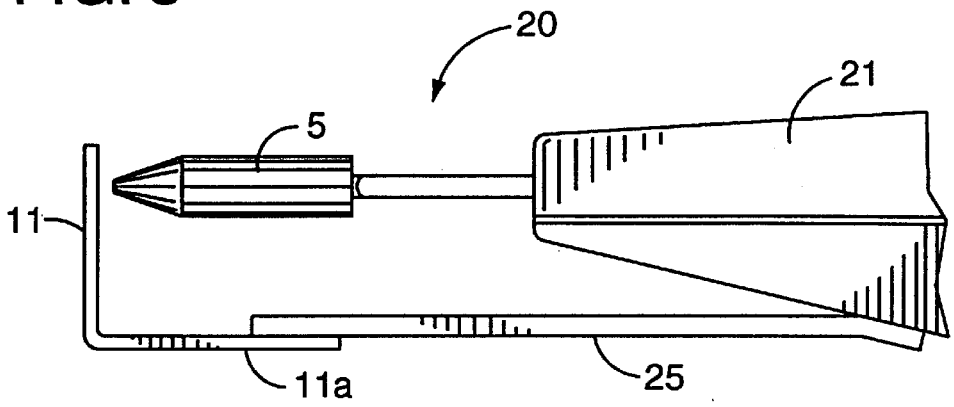
FIG. 5 is an enlarged, fragmentary side view of the tip portion of the heating device of FIG. 4.

The heating device 20, which is best seen in FIG. 4, includes a handle 21, the heater element 5 projecting from an end of the handle 21, and the aforementioned planar metal registration shield 11 which is resiliently carried by the handle 21 in spaced relation to the heater element 5. The heater element is turned on and off by means of a switch 24. The shield 11 includes a support flange 11*a* fixed to a thermal insulating support member 25 and is normally positioned about 0.03 inches from the tip of the heater element 5. However, due to the resilience of the metal shield, the heater element 5 may be brought into contact with the shield 11 by pressing the handle 21 towards the shield 11 while the latter is supported on a fixed surface. The heating device 20 thus affords the ability to provide a localized application of heat simultaneously with a much more generalized and distributed application of pressure. When the resilient shield 11 is removed from the supporting surface, it resumes its spaced relation to the heater element 5, and very rapidly cools down.

Figure 10:
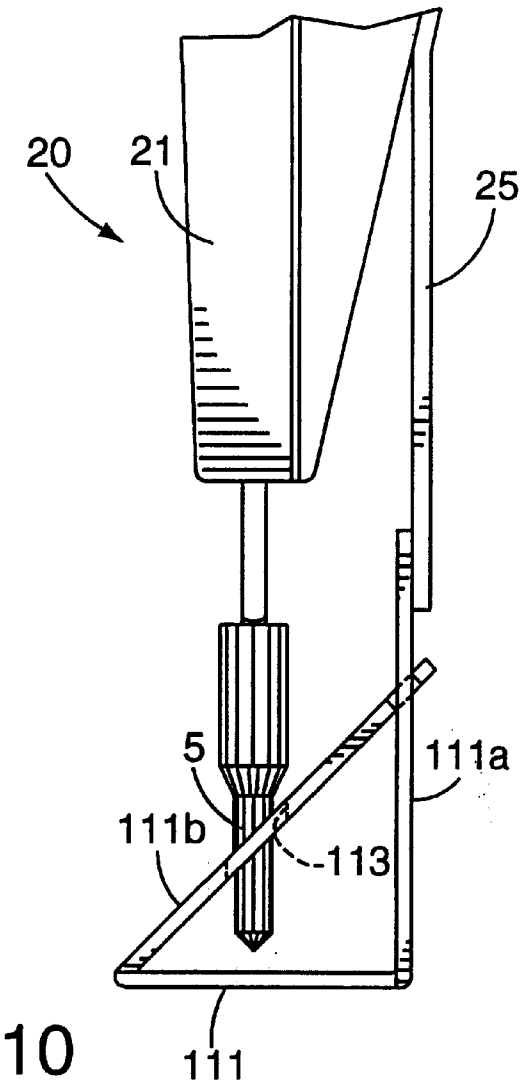
FIG. 10 is a side view of the registration shield of FIG. 9.
Figure 9:
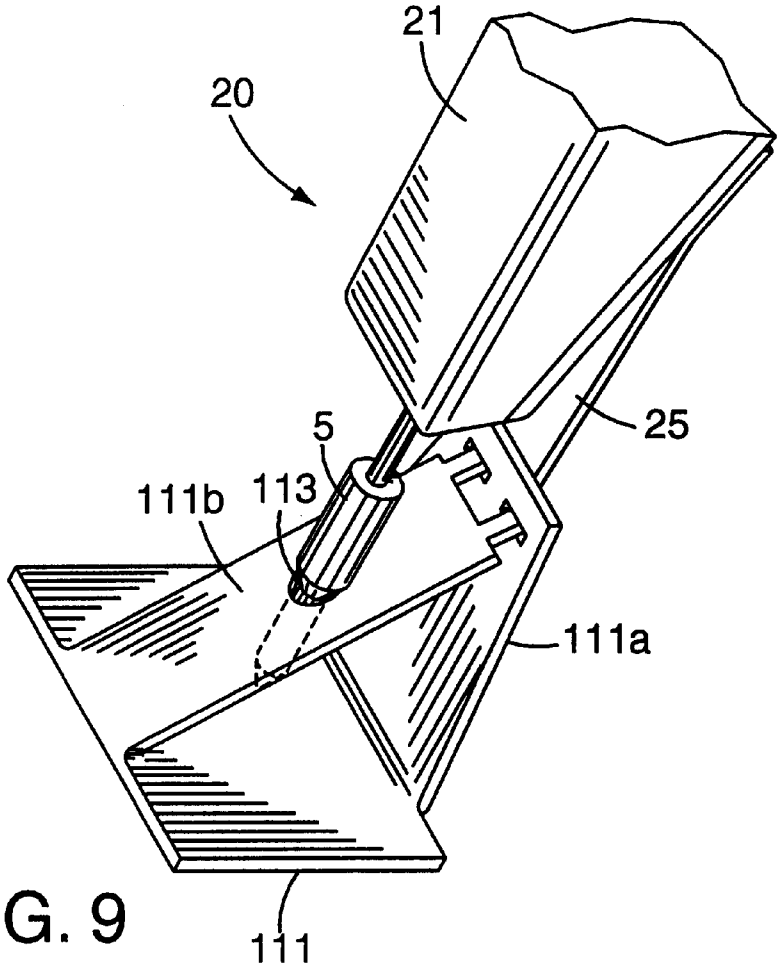
FIG. 9 is a perspective view of an alternate embodiment of a registration shield.

FIGS. 9 and 10 illustrate an alternate embodiment of the registration shield 111 wherein means are provided to keep the heater element 5 centered on the registration shield. The registration shield 111 of this embodiment differs from that previously described by the addition of an inwardly angled control member 111*b* integrally connected to the distal edge of the shield 111 and interlaced with the support flange 111*a*. An aperture 113 in the control member 111*b* is positioned in line with the handle 21 and the center of the shield 111. The tip of the heater element 5 projects through the aperture 113 so that the shield and the heater element are constrained against any lateral movement relative to one another.

The heater element 5 is an electrical resistance heater powered by rechargeable batteries (not visible) in the handle 21. A conventional battery recharger stand (not shown) is provided for recharging the batteries. For conventional pigmented materials used with thermal printers, the heater element circuit is arranged to provide for the rapid heating of the shield contact area to about 260°–280° F.

To address the problems of clouding and color change due to overlapping pigment, I utilize only a limited quantity of the pigmented material 7, comprising a dot 7*a* of approximately the same size as the void to be filled as shown in FIG. 3*a*. Since there are no marginal portions of the material which are not sufficiently heated and pressed against the receptor to effect transfer, there is no clouding. Likewise, there is little, if any area of overlap and, therefore, little if any area of color change.

Figure 6:
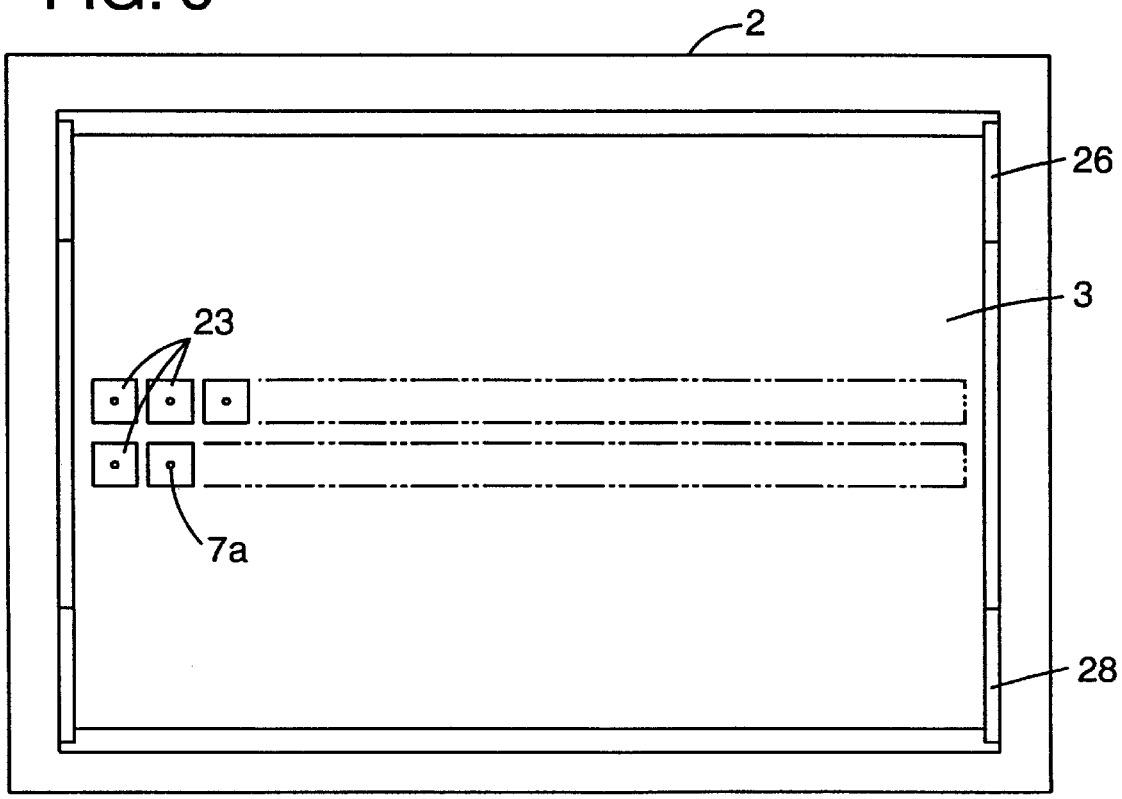
FIG. 6 is a plan view of a carrier foil cassette, with a series of void-repair dots formed on the foil.

I have found it to be a most efficient procedure to generate a number of pigmented material dots, in graduated sizes from the same foil as used for printing the image and, as part of the image printing operation. The dots are generated in the foil within squares having the shape of shield 11 or 111 by printing the negative of the squares on the receptor near the image. After stripping the foil from the receptor, the pigmented material corresponding to the dots remains in the squares or pigment-free windows on the carrier foil, and becomes the desired void-repair dots 7*a* in FIG. 3*a*. In FIG. 6, an array of such dots within pigment-free windows 23 is illustrated on the foil 3 carried on spools 26,28 within a cassette 2 used by a thermal printer. The windows 23 are not smaller than, and preferably are larger in size than the shield 11 to avoid a discoloration halo at the repair point. This procedure of utilizing the same foil as used in the printing operation insures that any void-repair dots which may be needed are readily at hand and are of a color exactly matching that of the image to be repaired and avoids the necessity of maintaining an inventory of repair material of various colors.

Figure 7:
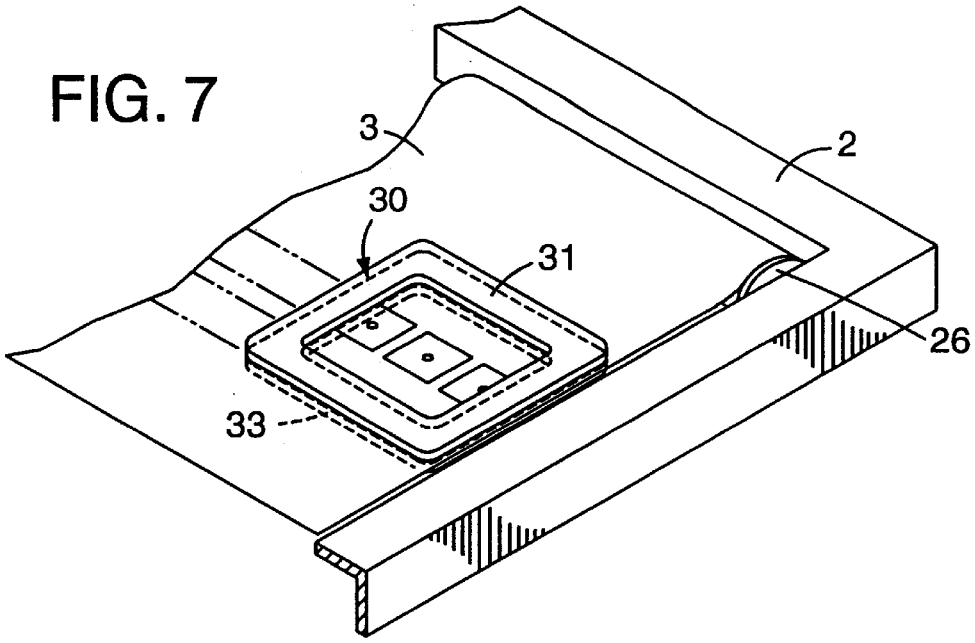
FIG. 7 is a perspective view of a piece of foil, bearing dots of pigmented material, clamped in a magnetic holder.

In order to facilitate handling of the foil 3 bearing the dots 7*a* of pigmented material, I have invented a convenient holder 30 for holding a selected piece of the foil in a flat and wrinkle-free condition. As illustrated in FIG. 7, the holder 30 in one form consists of first and second frames 31,33 of approximately the same size. The first frame 31 is made of metal, while the second frame 33 is made of a thermoplastic material impregnated with magnetic particles attracted to the metal of frame 31. A selected piece of the foil 3 is drawn taut and clamped between the magnetically attracted frames 31,33. It will be appreciated by the reader that the use of the holder 30 facilitates the use of a piece of foil 3 which is still in the cassette 2 in which it is generally sold and used. There is thus no need to cut the foil 3 to remove a piece from the cassette 2, thereby saving time and allowing the cassette 2 to be returned to service. Use of the holder 30 to support a piece of foil during the void repair process is seen in FIG. 7.

Figure 8:
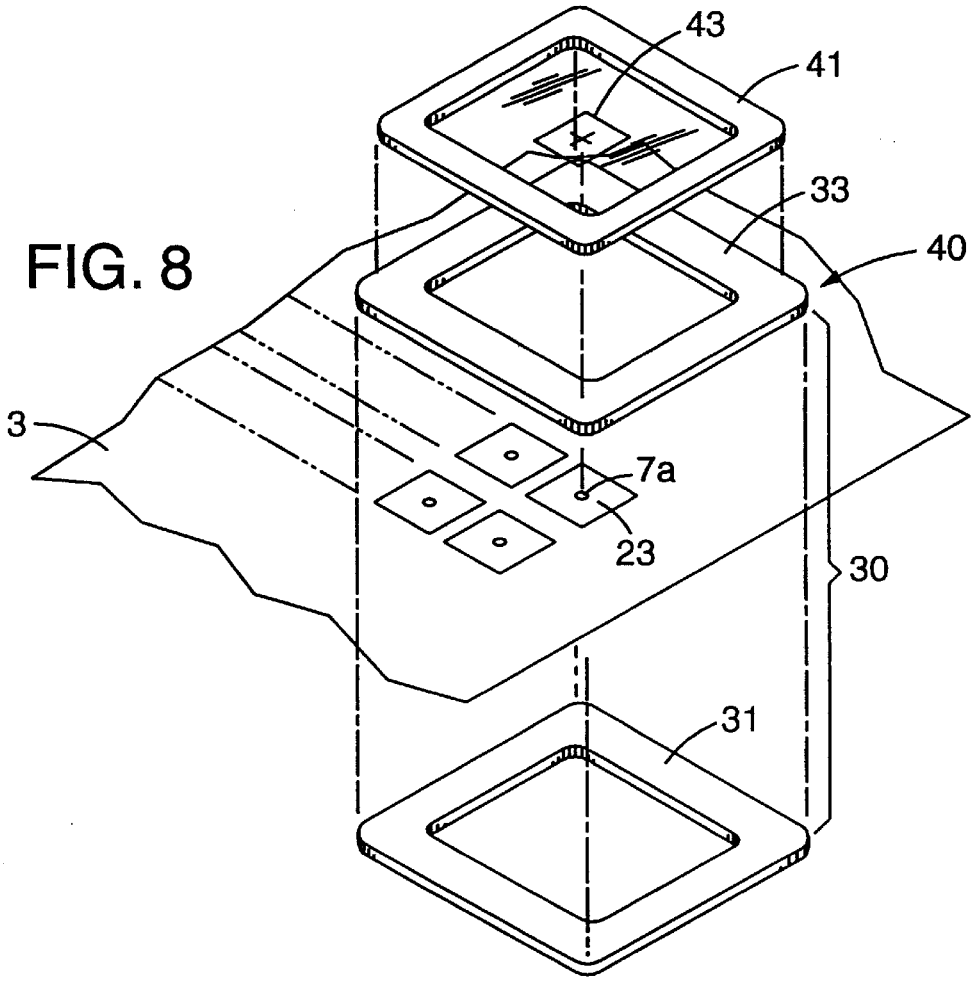
FIG. 8 is an exploded view, showing the foil and holder of FIG. 7, with the addition of a guide member.

A final problem which I encountered relates to the positioning of the dot 7*a* of pigmented material over the void in an image. Since the color of the dot is the same as the color of the pigmented background material bordering the void, it is possible though sometimes difficult to locate the dot against this background, while attempting to position the dot over the void. As an aid in locating the dot within the generally transparent window 23, I provide a guide member 40 which, in the embodiment illustrated in FIG. 8, includes a magnetic frame 41 similar to, but smaller than the second frame 33 of the holder 30. Adhesively fixed to the frame 41, is a transparent sheet 43 which may be formed of polycarbonate/polypropylene film, 0.0005 inches thick. Position indicating lines, which may take the form of an "X" with a gap at the intersection of the two lines, are imprinted on the sheet. The guide member 40, in this embodiment, is simply laid atop the frame 33, to which it will magnetically adhere, with the dot of pigmented material of the foil 3 underlying the intersection of the lines. Thus, the position-indicating lines on the transparent sheet 43 clearly show the location of the dot of pigmented material, facilitating its proper positioning when the dot is being shifted over the identically colored background toward a void in a printed image. The central opening in the frame 41 is preferably of a size to just admit the registration shield 11 of the heater 20, serving to guide the user to proper placement of the heater 20 to effect the repair. Heating of the dot is accomplished through the transparent sheet 43 of the guide member 40. The reader will appreciate that the guide member 40 could be integrated with the holder 30. In such a combination, a transparent sheet 43, imprinted with position-indicating lines, is adhesively attached to one of the guide frame members 31,33.

In general, the presence of a gap or void in a printed image printed by a thermal transfer printing process is the result of dirt or other foreign matter present on the receptor material during the printing process. Before proceeding with the repair process, therefore, it is necessary to remove any such material which may remain on the printed image. This may be done by mechanical scraping with the edge of a clean piece of stiff paper, such as a business card.

As hereinabove noted, the filling of a void is accomplished through the use of an appropriately sized dot of pigmented material. Advantageously, a series of dots 7*a* of graduated sizes is routinely generated in standard size windows 23 at the end of each print job. The cassette 2 holding the foil 3 bearing these dots is removed from the printing apparatus and the segment of the foil bearing the selected dot is clamped in the holder 30.

The guide member 40 is placed on the holder 30 such that the dot 7*a* appears in the gap in the position-indicating "X". With the dot now prominently marked, the holder 30 is placed on the flawed image, with the dot 7*a* superimposed over the void. The heater 20 is used to simultaneously heat the dot and press it onto the receptor material, thereby effecting the desired repair.

In addition to the repair process described above, the method and apparatus can also be used to create small images on a receptor material. Instead of preparing dots 7*a* in the pigmented material on the foil, a small image, such as an icon or symbol, e.g. ®, can be prepared in the ink on the foil by means of a thermal printer or other printing process to form a thermal transfer. The transfer on the foil is then placed at a desired location on a vinyl, paper or other receptor material with the ink confronting the material, and with the application of heat and pressure through the shield 11 or 111 from the heating device 5, the ink image is transferred from the foil 3 to the receptor material. If the size of the image is larger than the shield, the shield is moved from spot to spot over the image until the whole image has been heated and transferred.

As will be recognized by those skilled in the pertinent art, numerous changes and modifications may be made to the above-described and other embodiments of the present invention without departing from its scope as defined in the appended claims. For example, use of the holder 30 and guide member 40 can be omitted from the process by carefully positioning the dot of pigmented material over the void by hand and direct visual observation. The foil bearing the dot can be drawn or spread evenly by hand so that the heat applied to the foil is evenly distributed. The dots of pigmented material from the material originally used to print the graphic image are not essential to the process, and other foils with either configured or nonconfigured quantities of material can be used. Accordingly, the detailed description of the preferred embodiment herein is to be taken in an illustrative as opposed to a limiting sense.

I claim:

1. A method of filling a void in an image which has been printed on a receptor material by a process wherein a heat-sensitive pigmented material, coated on a foil, is transferred to the receptor material, the void-filling method comprising the steps of:

providing a piece of foil bearing, on a first surface, a quantity of pigmented material of the same color as the pigmented material bordering the void to be filled;

positioning said piece of foil over the image printed on the receptor material, with said first surface of said piece of foil facing the image and the quantity of pigmented material superposed over the void in the image; and applying heat to said piece of foil, proximate to said quantity of pigmented material, while pressing at least the heated portion of the foil against the printed image to transfer pigmented material from the foil into the void of the image, the foil being heated to about 260° F.–280° F.

2. The method of claim 1, wherein said piece of foil is a part of the foil used in the printing of the void-bearing image.

3. The method of claim 2, wherein said step of providing a piece of foil bearing a quantity of pigmented material includes the step of preparing the quantity of pigmented material during the process of printing the void-bearing image.

4. An apparatus for filling a void in an image which has been printed by a process wherein a heat-sensitive pigmented material, coated on a foil, is transferred to a receptor material, said apparatus comprising:

a piece of foil bearing a quantity of pigmented material of the same color as the pigmented material bordering the void to be filled, said quantity of pigmented material being in the form of a dot of approximately the same size as the void;

a heater for simultaneously applying heat and pressure to the foil in the vicinity of the dot; and guide means for facilitating the positioning of said piece of foil on the printed receptor, with the dot of pigmented material superposed over the void.

5. The apparatus of claim 4, wherein said piece of foil is a part of the foil used in the printing of the void-including image.

6. The apparatus of claim 4, wherein said guide means comprises a transparent member having position-indicating lines marked thereon.

7. A device for effecting the transfer of a heat-sensitive pigmented material from a foil on which it has been deposited to a sheet of receptor material, comprising:

a handle;

a heater element projecting from said handle; and a generally planar registration shield attached to said handle and resiliently carried in spaced relation to said heater element such that said heater element may be brought into contact with the shield by urging said handle towards said registration shield.

8. A method of creating an image on a receptor material comprising the steps of:

providing a piece of foil bearing a quantity of heat-sensitive pigmented material in the form of a desired image;

placing the foil on a receptor material with the image formed by the pigmented material confronting a selected location on the receptor material;

placing a heat-transmitting shield adjacent the foil in overlying relationship with the image; and applying heat to the image through the shield to release the pigmented material from the foil and transfer the material in the form of the image onto the receptor material.

9. A method of creating an image as defined in claim 8 wherein the image covers an area not larger than the overlying shield.

10. A method of creating an image as defined in claim 8 wherein the step of applying heat comprises placing a heating element in contact with the shield.

11. A method of creating an image as defined in claim 8 wherein the image covers an area larger than the heat-transmitting shield; and an additional step includes:

moving the shield from spot to spot over the image until the whole image is heated and transferred to the receptor material.

12. A method of filling a void in an image which has been printed on a receptor material by a process wherein a heat-sensitive pigmented material, coated on a foil, is transferred to the receptor material, the void-filling method comprising the steps of:

providing a piece of foil bearing, on a first surface, a quantity of pigmented material of the same color as the pigmented material bordering the void to be filled, the quantity of pigmented material being in the form of a dot of approximately the same size as the void;

positioning said piece of foil over the image printed on the receptor material, with said first surface of said piece of foil facing the image and the quantity of pigmented material superposed over the void in the image; and applying heat to said piece of foil, proximate to said quantity of pigmented material, while pressing at least the heated portion of the foil against the printed image to transfer pigmented material from the foil into the void of the image.

13. The method of claim 12, wherein the step of providing a piece of foil bearing a quantity of pigmented material in the form of a dot includes the steps of:

selecting a piece of the foil used in printing the void-bearing image; and removing from the selected piece of foil a predetermined portion of the pigmented material around the quantity constituting said dot.

14. The method of claim 13, wherein the piece of foil is heated by means applied to the guide member.

15. The method of claim 12, wherein said piece of foil is a part of the foil used in the printing of the void-bearing image.

16. The method of claim 15, wherein said step of providing a piece of foil bearing a quantity of pigmented material includes the step of preparing the quantity of pigmented material during the process of printing the void-bearing image.

17. A method of filling a void in an image which has been printed on a receptor material by a process wherein a heat-sensitive pigmented material, coated on a foil, is transferred to the receptor material, the void-filling method comprising the steps of:

providing a piece of foil bearing, on a first surface, a quantity of pigmented material of the same color as the pigmented material bordering the void to be filled;

positioning said piece of foil over the image printed on the receptor material, with said first surface of said piece of foil facing the image and the quantity of pigmented material superposed over the void in the image;

applying heat to said piece of foil, proximate to said quantity of pigmented material, while pressing at least the heated portion of the foil against the printed image to transfer pigmented material from the foil into the void of the image;

providing a transparent guide member having position-indicating lines marked thereon; and superposing said guide member on said piece of foil as an aid to positioning the foil with its quantity of pigmented material over the void.

18. The method of claim 17, wherein said piece of foil is a part of the foil used in the printing of the void-bearing image.

19. The method of claim 18, wherein said step of providing a piece of foil bearing a quantity of pigmented material includes the step of preparing the quantity of pigmented material during the process of printing the void-bearing image.

20. A method of filling a void in an image which has been printed on a receptor material by a process wherein a heat-sensitive pigmented material, coated on a foil, is transferred to the receptor material, the void-filling method comprising the steps of:

providing a piece of foil bearing, on a first surface, a quantity of pigmented material of the same color as the pigmented material bordering the void to be filled;

positioning said piece of foil over the image printed on the receptor material, with said first surface of said piece of foil facing the image and the quantity of pigmented material superposed over the void in the image; and applying heat to said piece of foil, proximate to said quantity of pigmented material, while pressing at least the heated portion of the foil against the printed image to transfer pigmented material from the foil into the void of the image, the step of applying heat while pressing the foil against the image including:

placing a metal shield over the piece of foil and the quantity of pigmented material; and applying the heat to the piece of foil and the quantity of pigmented material through the shield.

21. The method of claim 20 wherein the step of applying heat while pressing includes pressing the metal shield against the piece of foil and the quantity of pigmented material during the step of applying the heat through the shield.

22. The method of claim 20, wherein said piece of foil is a part of the foil used in the printing of the void-bearing image.

23. The method of claim 22, wherein said step of providing a piece of foil bearing a quantity of pigmented material includes the step of preparing the quantity of pigmented material during the process of printing the void-bearing image.

24. An apparatus for filling a void in an image which has been printed by a process wherein a heat-sensitive pigmented material, coated on a foil, is transferred to a receptor material, said apparatus comprising:

a piece of foil bearing a quantity of pigmented material of the same color as the pigmented material bordering the void to be filled, said quantity of pigmented material being in the form of a dot of approximately the same size as the void;

a heater for simultaneously applying heat and pressure to the foil in the vicinity of the dot; and holding means for holding at least a portion of the piece of foil in a substantially planar and wrinkle-free condition.

25. The apparatus of claim 24, wherein said holding means comprises magnetically attracted first and second frame members adapted to be placed on opposite sides of the piece of foil, with the foil clamped therebetween.

26. The apparatus of claim 25, wherein a transparent guide member is fixed to one of said first and second frame members to aid in positioning the dot of pigmented material over the void.

27. The apparatus of claim 24, wherein said piece of foil is a part of the foil used in the printing of the void-including image.

28. An apparatus for filling a void in an image which has been printed by a process wherein a heat-sensitive pigmented material, coated on a foil, is transferred to a receptor material, said apparatus comprising:

a piece of foil bearing a quantity of pigmented material of the same color as the pigmented material bordering the void to be filled, said quantity of pigmented material being in the form of a dot of approximately the same size as the void; and a heater for simultaneously applying heat and pressure to the foil in the vicinity of the dot, the heater including:

a handle;

a heater element projecting from said handle; and a generally planar registration shield attached to said handle and resiliently carried in spaced relation to said heater element such that said heater element may be brought into contact with the shield by urging said handle towards said registration shield.

29. The apparatus of claim 28 further comprising control means carried by said registration shield for limiting movement of said heater element relative to said registration shield.

30. The apparatus of claim 29, further including a transparent guide member carried within an opening of a guide frame, said opening being of a size and shape to admit said registration shield.

31. The apparatus of claim 28, wherein said piece of foil is a part of the foil used in the printing of the void-including image.

* * * * *